United States Patent [19]

Cheng

[11] Patent Number: 4,999,914

[45] Date of Patent: Mar. 19, 1991

[54] SPRING OPERATED IMPACT TOOL

[76] Inventor: Yin H. Cheng, No. 1, Alley 78, Lane 113, Sec. 2, Chung Shan Road, Shu Lin, Taipei Hsien, Taiwan

[21] Appl. No.: 526,159

[22] Filed: May 21, 1990

[51] Int. Cl.[5] ..... B26B 7/00; B26F 1/00; B25B 27/14

[52] U.S. Cl. ..... 30/272.1; 30/358; 29/271

[58] Field of Search ..... 30/272.1, 358, 367, 30/277, 106; 29/271, 272, 278, 28; 81/468

[56] References Cited

U.S. PATENT DOCUMENTS

| | | | |
|---|---|---|---|
| 2,409,589 | 10/1946 | Rocheville | 30/358 |
| 2,545,237 | 3/1951 | Maby | 30/358 |
| 2,770,037 | 11/1956 | Bjorklund et al. | 30/358 |
| 3,063,319 | 11/1962 | Johnson | 30/358 |
| 4,817,258 | 4/1989 | Waters | 29/271 |

*Primary Examiner*—Hien H. Phan
*Assistant Examiner*—Paul M. Heyrana, Sr.
*Attorney, Agent, or Firm*—Lowe, Price, LeBlanc, Becker & Shur

[57] ABSTRACT

A spring operated pinching device, which includes a housing defining therein a plurality of scoop channels for receiving an adjusting knob, an actuating member, a guide board member and a tool holder member, with a compression spring set between the adjusting knob and the actuating member, with a guide rod member and an eccentric spring set between the guide board member and the tool holder member, and with a board tool member fastened in the tool holder member. The downward pressing force of the housing against the board tool member forces the tool holder member to squeeze the eccentric spring permitting the guide rod member to insert through the guide board member into the actuating member so that the instantaneous expansion force from the compression spring forces the actuating member to drive the board tool member to connect a telephone wire to a wiring board by means of squeeezing process.

1 Claim, 4 Drawing Sheets

SPRING OPERATED IMPACT TOOL

BACKGROUND OF THE INVENTION

The present invention is to provide a Spring operated impact tool for connecting and cutting telephone wires, which utilizes a guide rod member and a guide board member to correct the position of an eccentric spring so that a compression spring can efficiently force a tool holder member to drive a board tool member to squeeze and cut telephone wires.

BRIEF DESCRIPTION OF THE DRAWINGS

The present invention will now be described by way of example with reference to the annexed drawings, in which.

SUMMARY OF THE INVENTION

Figure 1:
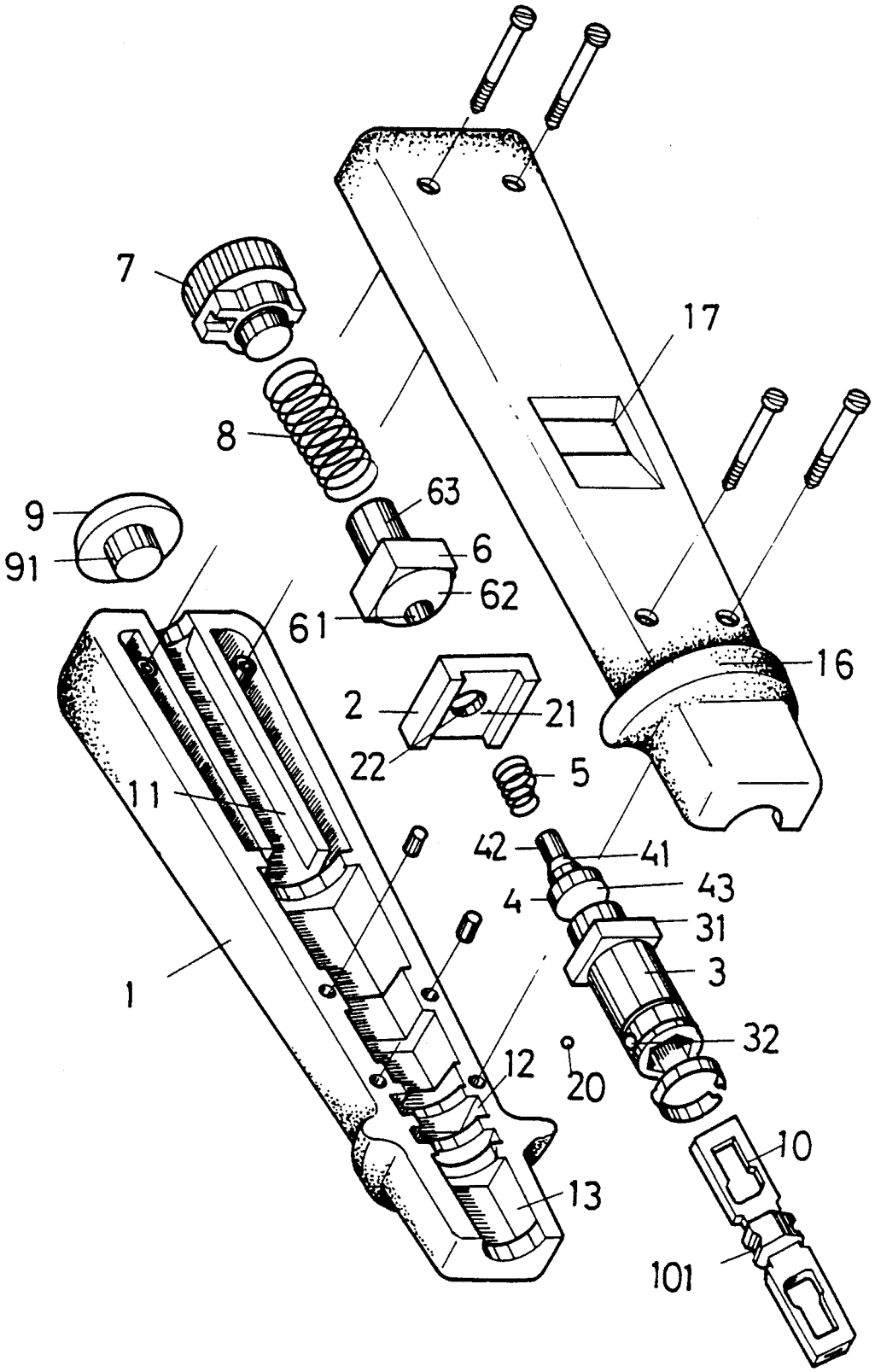
FIG. 1 is a perspective exploded view of the present invention.
Figure 2:
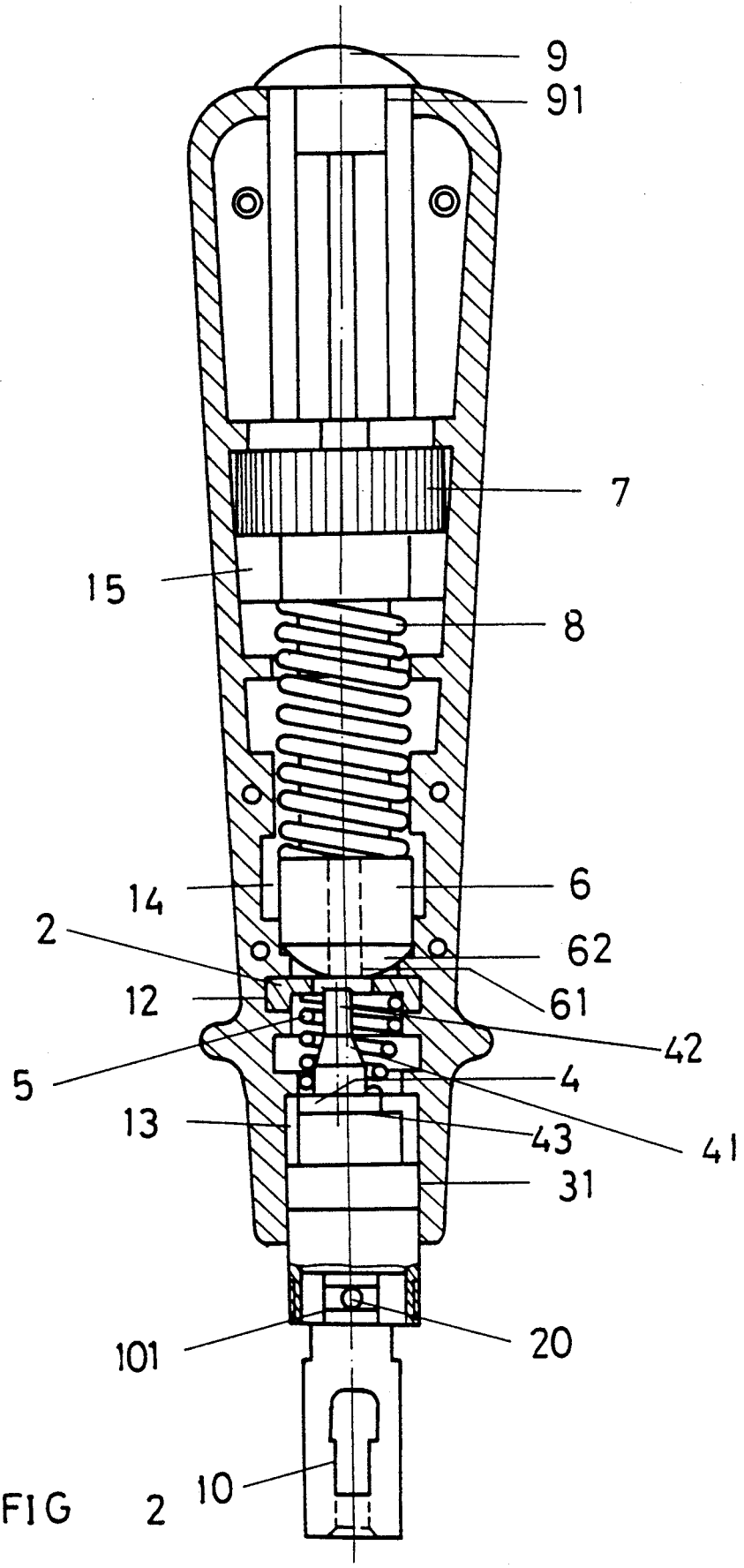
FIG. 2 is a sectional plan view thereof.
Figure 3:
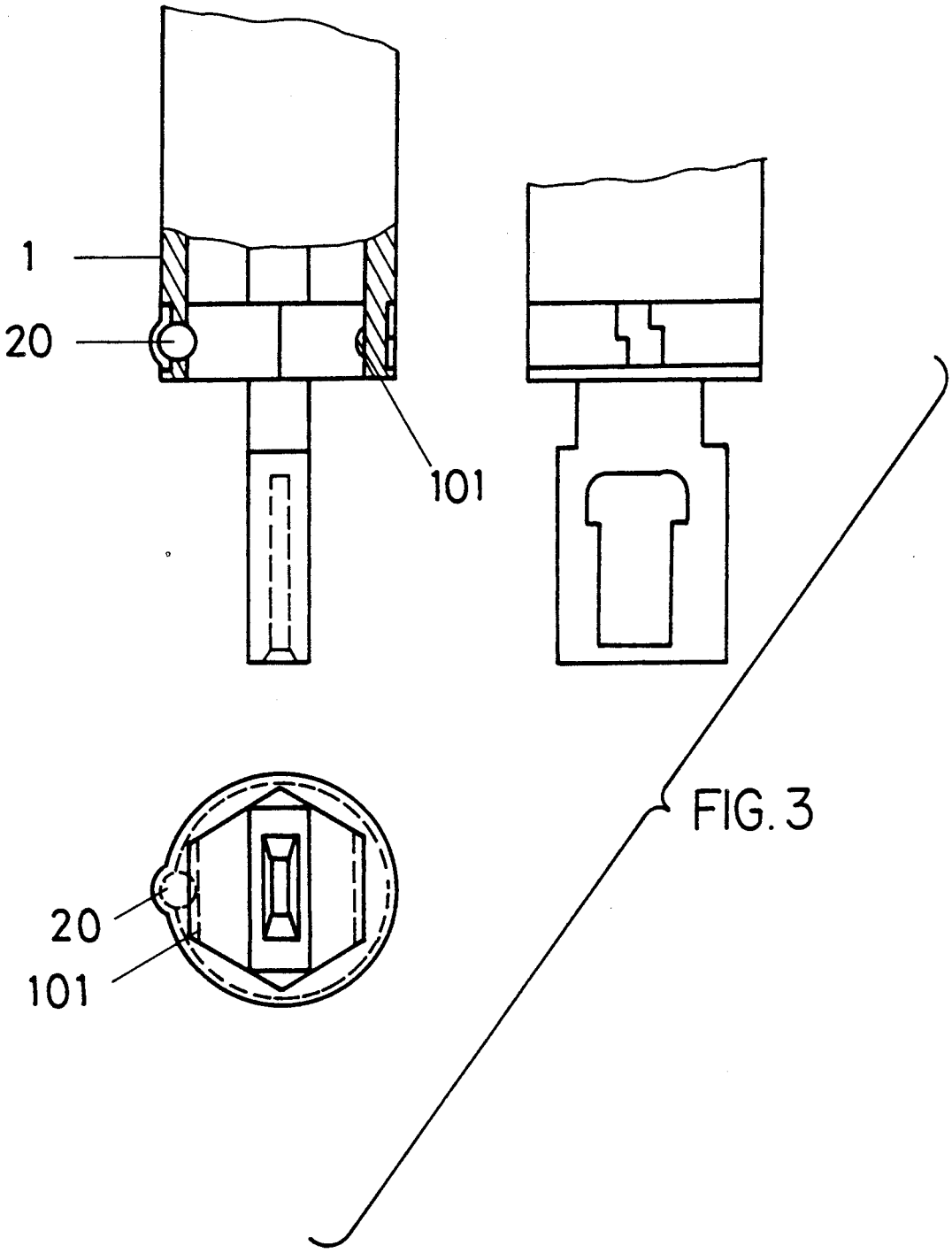
FIG. 3 illustrates the relative position of the board tool member in the tool holder member.

A spring operated pinching device, which includes a housing defining therein a plurality of scoop channels for receiving an adjusting knob, an actuating member, a guide board member and a tool holder member, with a compression spring set between the adjusting knob and the actuating member, with a guide rod member and an eccentric spring set between the guide board member and the tool holder member, and with a board tool member fastened in the tool holder member. The downward pressing force of the housing against the board tool member forces the tool holder member to squeeze the eccentric spring permitting the guide rod member to insert through the guide board member into the actuating member so that the instantaneous expansion force from the compression spring forces the actuating member to drive the board tool member to connect a telephone wire to a wiring board by means of squeezing process.

DETAILED DESCRIPTION OF THE PREFERRED EMBODIMENT

Turning now to the annexed drawings in greater detail, a spring operated impact tool in accordance with the present invention is generally comprised of a housing 1, a guide board member 2, a tool holder member 3, a guide rod member 4, an eccentric spring 5, an impact 6, an adjusting knob 7, a compression spring 8, a cap 9 and a board tool member 10. The housing 1 is comprised of two parts defining therein a storage chamber 11 at one side and a plurality of scoop channels 12, 13, 14, 15 at an opposite side, and comprising externally a projecting collar 16 and a slot 17. The guide board 2 defines therein a concave portion 21 having a hole 22 therethrough, and is firmly positioned in the scoop channel 12 of the housing 1. The tool holder member 3 comprises externally a projecting portion 31 and a hole 32 for the setting therein of a steel ball 20, and is movably received in the scoop channel 13 of the housing 1. By means of the effect of the projecting portion 31, the tool holder member 3 is confined to move along axial direction within the scoop channel 13 of the housing 1. The guide rod member 4 is a stepped rod having a tapered plane portion 41 in the middle, an elongated head end 42 at one end and a larger flat surface portion at the back to stop against the tool holder member 3. The eccentric spring 5 is sleeved on the guide rod member 4 and stopped between the guide rod member 4 and the guide board member 2. The actuating member 6 has a hole 61 through its central axis, an arch-shaped surface portion 62 on its one end and unitary axle 63 extending from its opposite end. During assembly, the actuating member 6 is received in the scoop channel 14 of the housing 1 with its arch-shaped surface portion 62 stopped against the guide board 2. The adjusting knob 7 is set inside the housing 1 with its thread portion partly protruding beyond the slot 17 of the housing 1 for easy operation. The compression spring 8 is sleeved on the unitary axle 63 and set between the actuating member 6 and the adjusting knob 7. The cap 9 has an unitary axle 91 extending therefrom at one end. During assembly, the unitary axle 91 of the cap 9 is inserted in the housing to seal the storage chamber 11. The board tool member 10 has a notch 101 in the middle into which the steel ball 20 from the hole 32 of the tool holder member 3 is set to retain the board tool member 10 in the tool holder member 3.

Figure 4A:
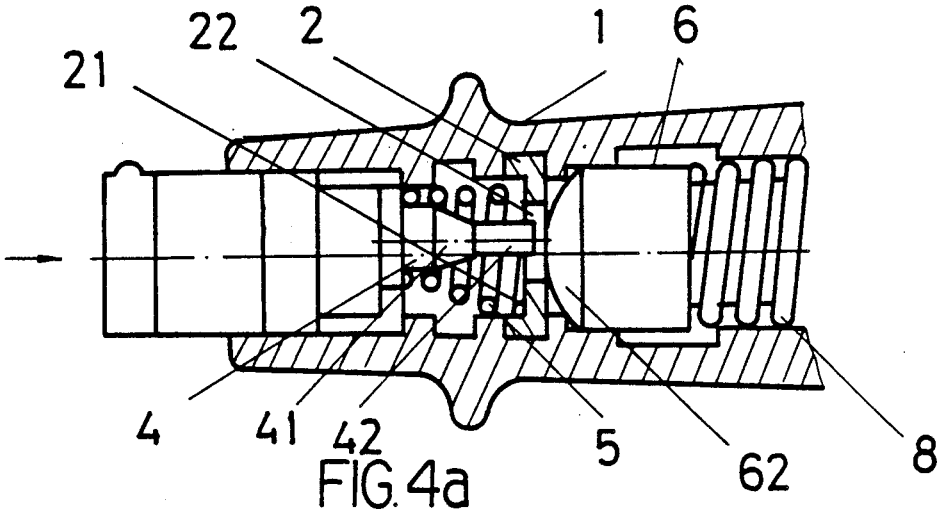
FIG. 4A–AC are schematic drawings, illustrating a series of continuous motion of the operation of the present invention.
Figure 4B:
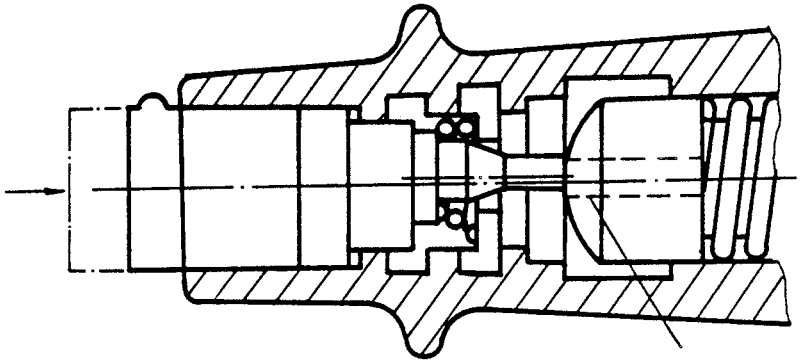
Figure 4C:
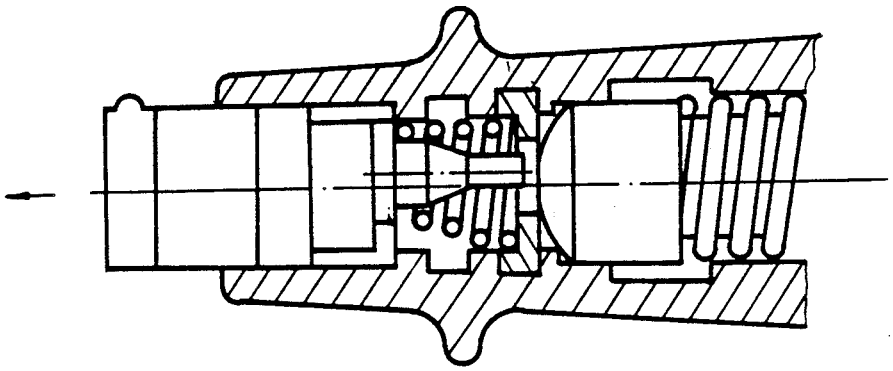

The operation of the present invention in connecting telephone wires is outlined hereinafter. Set the board tool member 10 in the wiring board to which a telephone wire is to be connected and press down the housing 1 permitting the tool holder member 3 to push the guide rod member 4 so as to compress the eccentric spring 5 (See FIG. 4-C). Because the eccentric spring 5 is at an eccentric condition and the elongated head end 42 of the guide rod member 4 is stopped against the arch-shaped surface portion 62 of the actuating member 6, the actuating member 6 is moved by the guide rod member 4 to squeeze the compression spring 8 to compress Under this condition, the tapered plane portion 41 of the guide rod member 4 is guided by the hole 22 of the guide board member 2 so that the elongated head end 42 of the guide rod member 4 is permitted to insert in the hole 61 of the actuating member 6 ( see FIG. 4C). As soon as the elongated head end 42 of the guide rod member 4 inserts in the hole 61 of the actuating member 6, is compression spring 8 is released to instantaneously expand. During expansion of the compression spring 8, the actuating member 6 forces the guide rod member 4 to push the tool holder member 3 to rush outward so as to drive the board tool member 10 to connect the telephone wire to the wiring board by means of squeezing process.

As described above, the tapered plane portion 41 of the guide rod member 4 efficiently guide the eccentric spring 5 to correct position permitting the elongated head end 42 of the guide rod member 4 to smoothly insert in the hole 61 of the impact member 6. By means of the instantaneous expansion force of the compression spring 8, the board tool member 10 is forced by the striking force from the guide rod member 4 to crimping and cut telephone wires. Another feature of the present invention is that the cap 9 can be conveniently removed from and attached to the housing 1 so that the board tool member 10 can be received in or taken out of the storage chamber 11 of the housing 1. The two opposite parts of the housing 1 are relatively positioned by means of pins and firmly connected together by means of rivet 30 through bolt holes 18.

I claim:

1. A spring operated pinching device, comprising a housing, a guide board member, a tool holder member having a central axis, a guide rod member, an eccentric spring, an actuating member having a central axis, an adjusting knob, a compression spring, a cap and a board tool member, said housing being comprised of two parts and defining therein a storage chamber at one side and sealed by said cap for receiving tool parts and a plurality of scoop channels at an opposite side for receiving said guide board member, said tool holder, said actuating member and said adjusting knob;

wherein said guide board has a hole made thereon; said tool holder member comprises externally a projecting portion and a hole for the setting therein of a steel ball; said guide rod member is a stepped rod having a tapered plane portion in the middle, an elongated head end at one end and a larger flat surface portion at the back to abut against said tool holder member; said eccentric spring is sleeved on the elongated head end of said guide rod member and located between said guide rod member and said guide board member; said actuating member has a hole through the central axis, an arch-shaped surface portion on its one end to abut against said guide board and an unitary axle extending from its opposite end; said compression spring is sleeved on said unitary axle of said actuating member and set between said actuating member and said adjusting knob; and said board tool member has a notch in the middle for the setting therein of said steel ball inside the hole of said tool holder member to secure said board tool member to said tool holder member; and being characterized in that the downward pressing force of said housing against said tool member forces the head end of the guide rod member against the arch-shaped surface and thus compresses the compression a spring and squeezes said eccentric spring permitting said guide rod member to be guided toward the hole of said guide board member and enter into the hole of said actuating member allowing the compressed compression spring to expand so that the expansion force from said compression spring forces said actuating member to drive said board tool member downwardly to impact the guide rod member to drive the tool holder downwardly.

* * * * *